US005096160A

United States Patent [19]

Calico et al.

[11] Patent Number: 5,096,160

[45] Date of Patent: Mar. 17, 1992

[54] AUTOMOTIVE JACK

[75] Inventors: Gregory M. Calico, Conway; Judson D. Spillyards, North Little Rock; Ronald L. Hill, Conway, all of Ark.

[73] Assignee: FMC Corporation, Chicago, Ill.

[21] Appl. No.: 750,743

[22] Filed: Aug. 21, 1991

Related U.S. Application Data

[63] Continuation of Ser. No. 316,345, Feb. 27, 1989, abandoned.

[51] Int. Cl.[5] ..... B66F 3/24

[52] U.S. Cl. ..... 254/93 HP; 254/122

[58] Field of Search ..... 254/2 R, 2 B, 2 C, 93 HP, 254/122, 124

[56] References Cited

U.S. PATENT DOCUMENTS 2,070,960 2/1937 Phillips ..... 254/93 HP
2,725,578 12/1955 Keller ..... 254/93 HP
3,174,722 3/1965 Alm ..... 254/93 HP
3,994,474 11/1976 Finkbeiner ..... 254/93 HP
4,087,895 5/1978 Etienne ..... 254/93 HP

*Primary Examiner*—J. J. Hartman
*Attorney, Agent, or Firm*—J. Preston Oxenham; Richard B. Megley

[57] ABSTRACT

A scissor jack of the type which is mountable on and usable in conjunction with a conventional automotive vehicle lift to permit a selected axle of the vehicle to be elevated relative to the lift. The invention provides a gravity activated locking mechanism which includes a plurality of lock keys of different widths. The keys fall individually into a lock position as the jack rises incrementally in height, to prevent unintended lowering of the jack at any height or any time during the lifting process.

13 Claims, 5 Drawing Sheets

AUTOMOTIVE JACK

This application is a continuation of application Ser. No. 07/316,345, filed Feb. 27, 1989 now abandoned.

This invention relates to scissor jacks generally, and more particularly to such jacks which are mounted on and useable with an automotive vehicle lift.

The present invention is an improved scissor jack of the type which is mountable on and useable in conjunction with a conventional automotive vehicle lift to permit a selected axle of the vehicle to be elevated relative to the lift. The invention provides a lock mechanism for such a jack which prevents unintended lowering, when extended, which is relatively simple to manufacture and maintain and which is reliable and easy to operate. The invention also provides flexibility in adapting the lifting pad to a variety of vehicles, a convenient mounting of operative valves which permits efficient and safe automotive practices in the servicing of vehicles.

These and other attributes of the present invention, and many of the attendant advantages thereof, will become more readily apparent upon a perusal of the following description and the accompanying drawings, wherein:

FIG. 9 is a view similar to FIG. 8 but with the lock mechanism in its release position.

Figure 1:
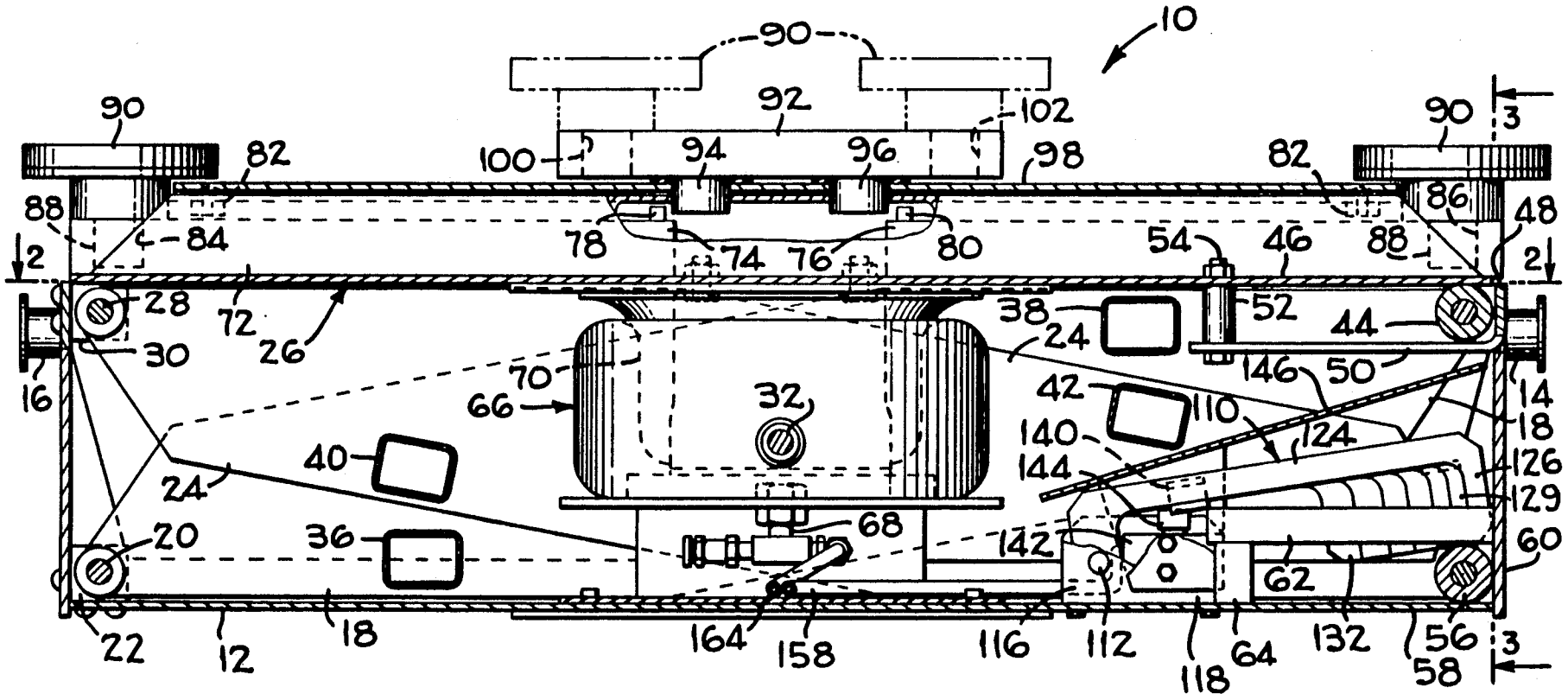
FIG. 1 is an elevational view, with portions broken away, of a scissor jack according to the present invention.
Figures 2, 4:
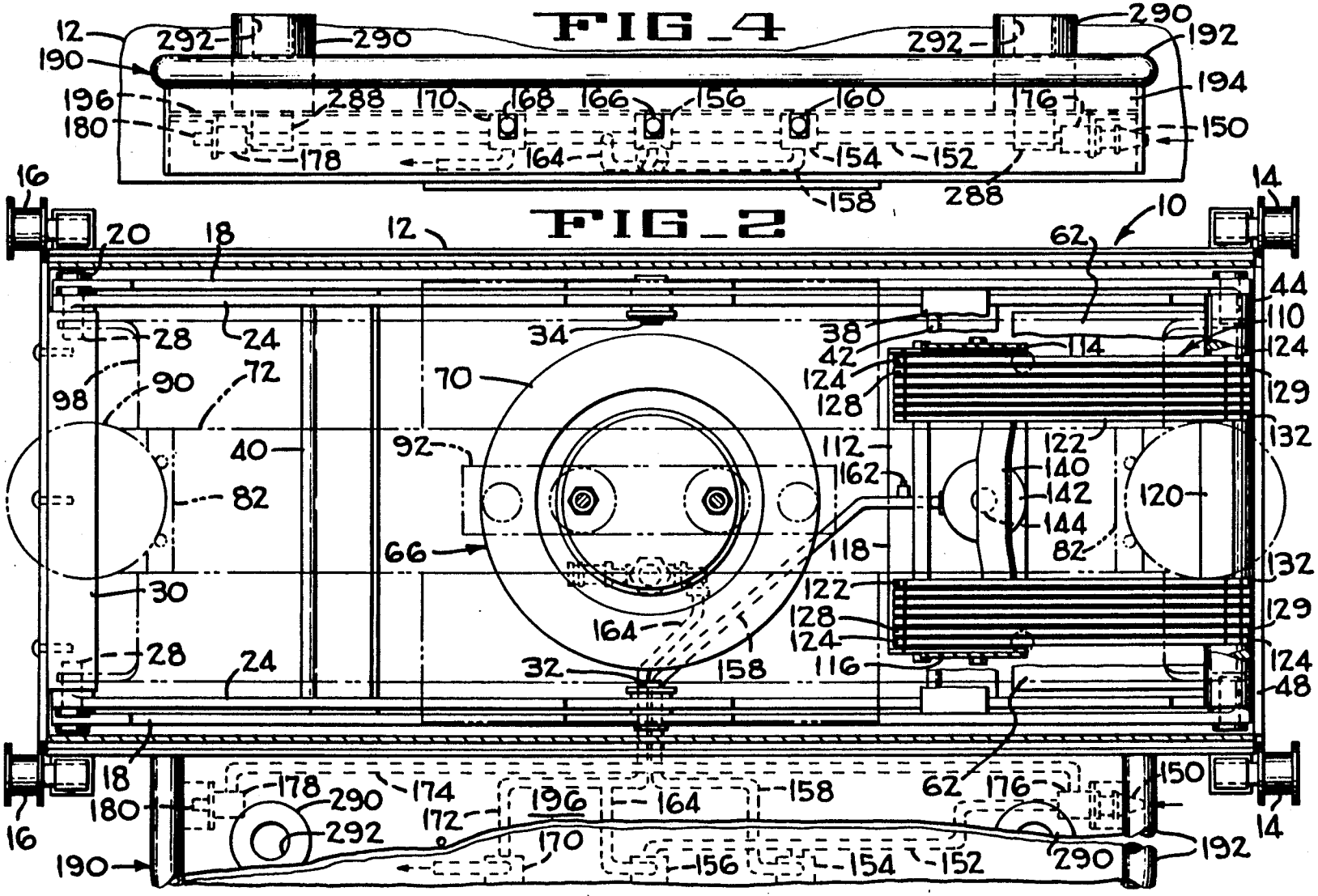
FIG. 2 is a horizontal section taken on line 2—2 of FIG. 1.
FIG. 4 is a front elevational view of the tool tray and related components of the present invention.
Figure 3:
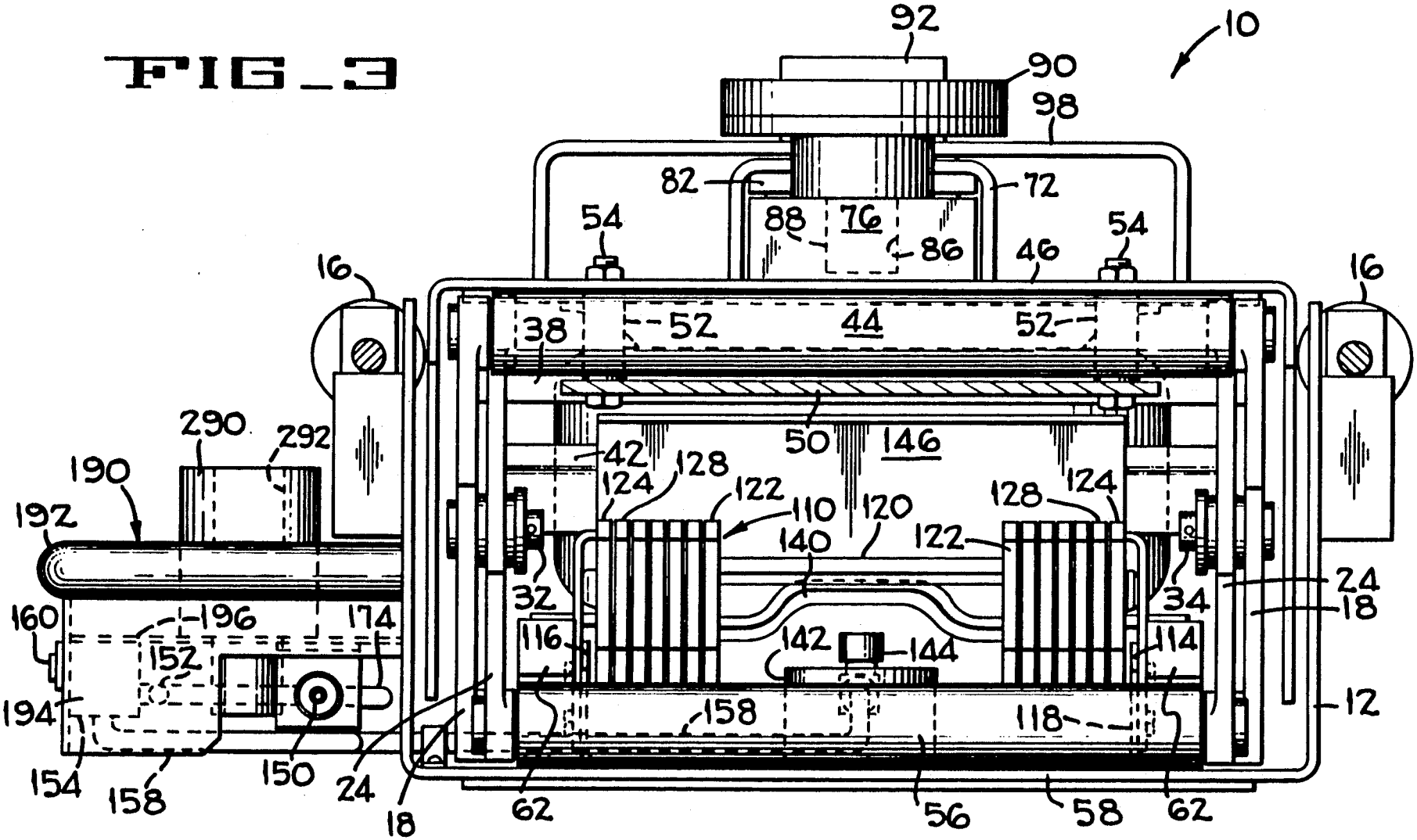
FIG. 3 is a vertical section taken on line 3—3 of FIG. 1.

Referring now to FIGS. 1, 2 and 3, there is shown a scissor jack, indicated generally at 10, having a base 12, which is rectangular in plan view with the major dimension being sufficient to essentially span the distance between a pair of jack rails, not shown, secured to and running parallel to the inner sides of the runways of a conventional vehicle lift. Two pair of flanged rollers 14 and 16 are rotatably secured to the upper ends of the base 12. Each pair of rollers is supported by one of the pair of jack rails and is capable of rolling along the rails to permit positioning of the jack under a selected axle of a vehicle having its wheels resting on the runways. A pair of outer scissor arms 18 are pivotally attached at their lower ends to the base 12 by means of pins 20 which extend through the arms 18 and are secured to a lower trunnion 22 bolted to the inside of the base 12. A pair of inner scissor arms 24 are pivotally attached at their upper ends to the extendable top 26 by pins 28 extending through the arms 24 and secured to an upper trunnion 30 bolted to the top 26. The adjacent outer and inner arms 18 and 24 are pivotally connected by pins 32 and 34. A pair of cross tubes 36 and 38 extend between and are secured to each of the outer arms 18. Similarly, cross tubes 40 and 42 extend between and are secured to each of inner arms 24. An upper roller 44 extends between and is rotatably secured to the upper ends of the outer arms 18 freely rotatable roller 44 the lower surface of lower member 46 of top 26 and supports is confined by lower surface 46, outer top flange 48, roller support 50 and a pair of stop tubes 52. Roller support 50 is formed integrally with flange 48. Stop tubes 52 are held in place by bolts 54 extending through support 50, the tubes 52 and the member 46. Horizontal displacement of roller 44 is thus limited by tubes 52 and flange 48 tubes 52 and also serve as spaces to properly position support 50 when the bolts and engaging nuts are tightened. Lower roller 56 extends between, and is rotatably attached to the lower ends of outer arms 24. Freely rotatable roller 56 is supported by the upper surface of bottom member 58, of base 12. Lower roller 56 is confined by end member 60 of base 12, bottom member 58, a pair of horizontal bars 62 and upright supports 64 attached to bars 62. Bars 62 are secured to end member 60 and to the supports 64, which supports are secured to bottom member 58.

Air bag 66 is extends between and is connected to bottom member 58 of base 12 and lower member 46 of top 26. Pressurized air may be introduced into or exhausted from the interior of air bag 66 by means of pipe 68. When air is exhausted from the air bag 66, top 26 may be lowered to the position shown in FIG. 1. Introducing air under pressure to air bag 66 will force piston 70 of air bag 66 to move upward and arms 18 and 24 to rotate about their fixed pivots so that the change in vertical elevation of the pins 28 and roller 44 matches the upward movement of piston 70. The resulting horizontal displacement is accommodated by rollers 44 and 56 moving inward, as can be seen in FIGS. 5-8.

Lower member 46 of the top has a rectangular shape in plan view similar to that of base 12, the flanges extending downward from the lower member 46 being contiguous with the side and end walls of base 12 when the jack is in its lower-most position. An inverted U-shaped channel 72 is centered on longitudinal centerline of the lower member 46 and has its free ends secured thereto. Left and right lifting arms 74 and 76 are slidably engaged by channel 72 and upper surface of member 46 and protrude from respective open ends of the channel 72. Stop bars 78 and 80 are respectively secured to upper surfaces of the inner ends of arms 74 and 76 and are engageable with stops 82 secured near the outer ends of channel 72 to limit the outward travel of lifting arms 74 and 76. The outer ends of arms 74 and 76 are provided with sockets 84 and 86 respectively into which mounting post 88 of lift pad 90 may be removably inserted. Lifting arms 74 and 76 are thereby selectively adjustable laterally of the jack 10 to position lift pads 90 to engage the proper component of the vehicle so that it may be elevated without structural damage thereto. Since some vehicles require that the lifting forces be exerted near the center of the axle, lifting adapter 92 having a pair of mounting posts 94 and 96, which posts are comparable to the posts 88 on the pads 90, is provided. Each of the posts 94 and 96 engage a pair of aligned openings in the cover 98, which is secured to top 26, and channel 72. The adapter 92 has sockets 100 and 102 near its outer ends to accept the posts 88 of the pads 90. A adapter 92 provides additional height to minimize the otherwise wasted elevation of the jack before actual lifting of the vehicle begins. Posts 88 of the pads 90 may also be positioned directly in the openings that accept the adapter posts 94 and 96.

Figures 5, 6, 7:
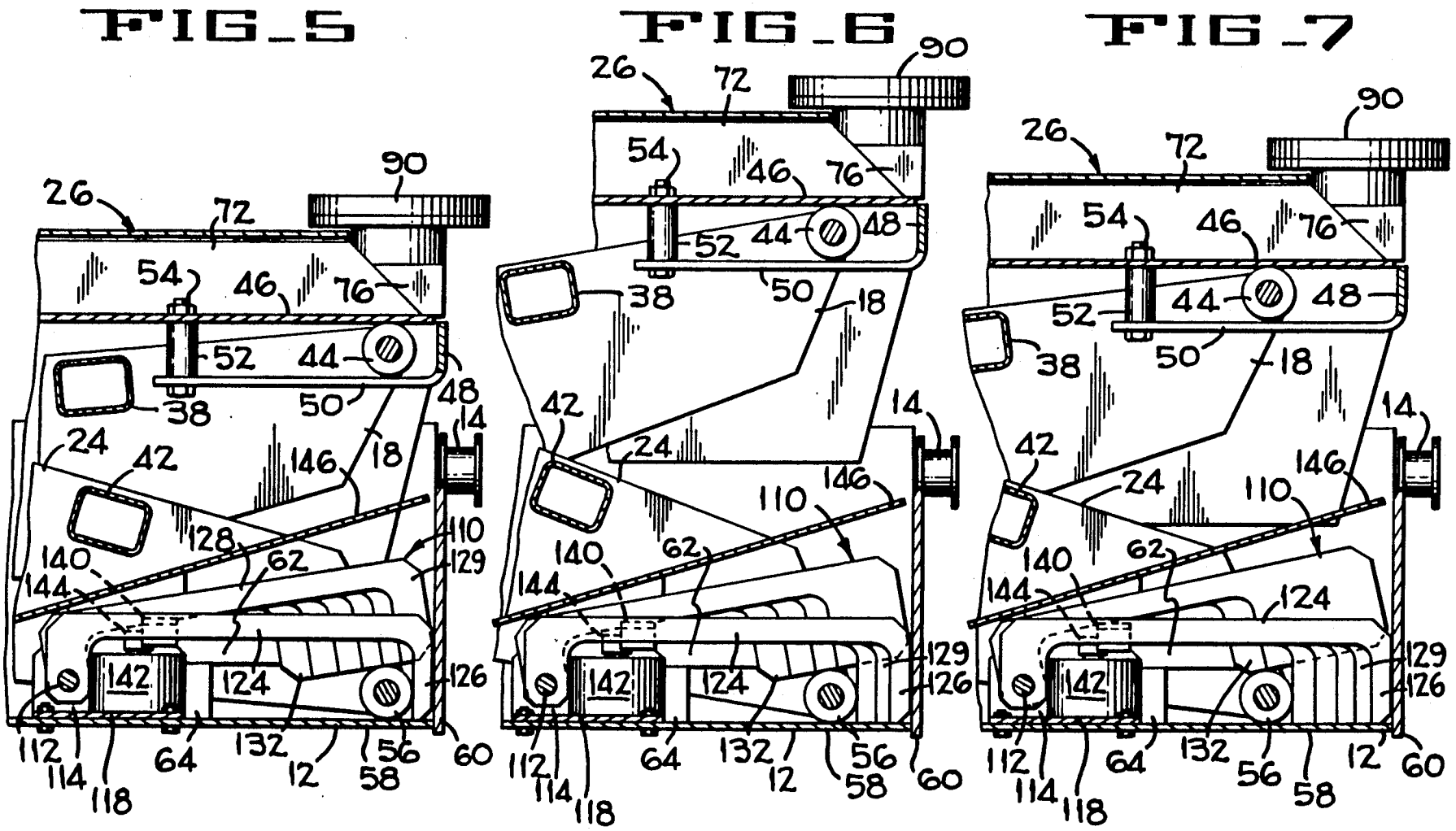
FIGS. 5, 6 and 7 are sectional views showing the lock mechanism with the jack at varying degrees of extension.
Figure 5:
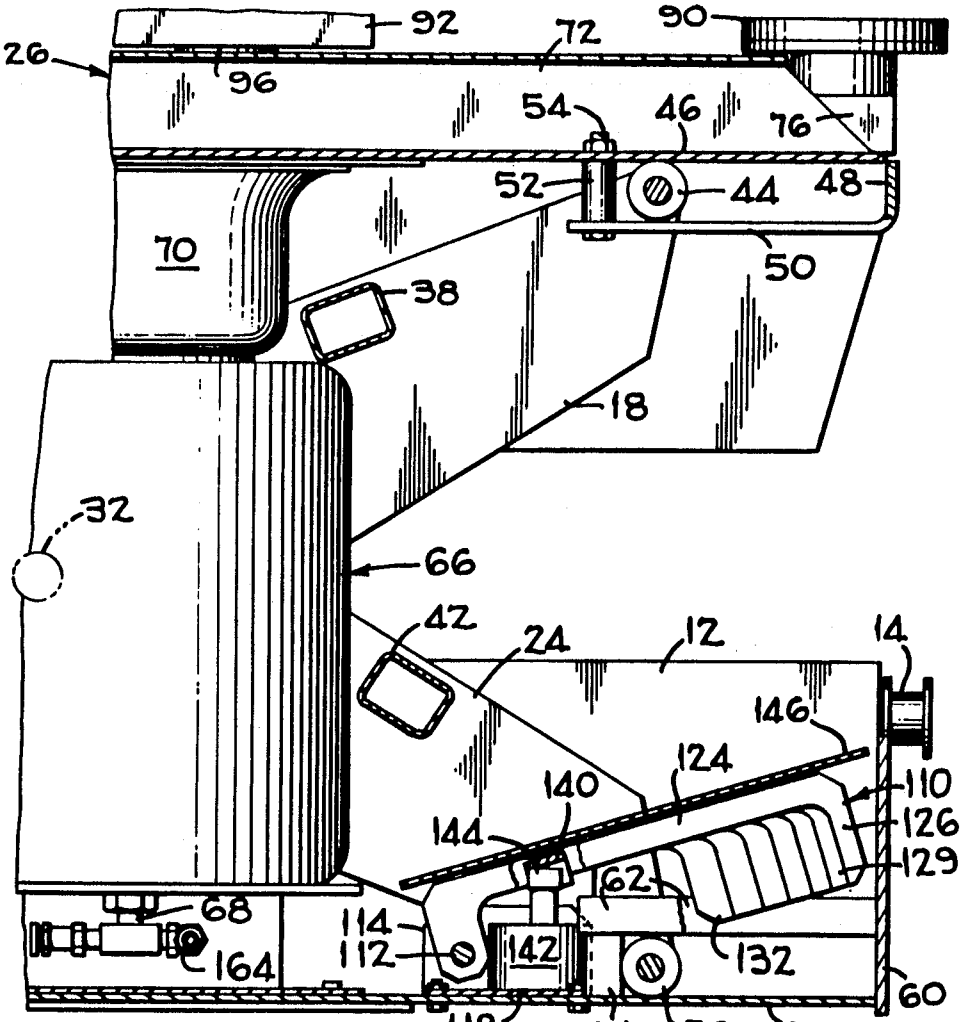
Figure 8:
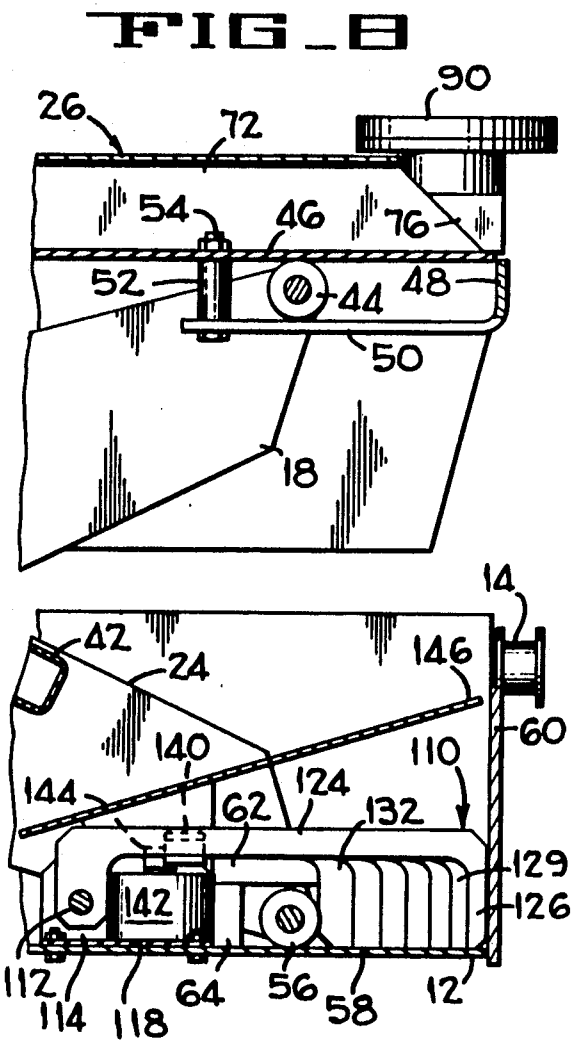
FIG. 8 is a view similar to FIGS. 5, 6 and 7 showing the jack almost fully extended.

A lock mechanism, indicated generally at 110, is provided to automatically lock the jack at predetermined incremental elevations and includes pivot rod 112 secured between upstanding ends 114 and 116 of bracket 118 secured to the member 58. An even-numbered plurality of latch arms are freely, rotatably mounted on the pivot rod 112 and are arranged into forward and rearward groups of equal number. A spacer bar 120 is secured to inner latch arm 122 of each group to assure the integrity of the two groups. Outer latch arms 124 are identical, with each having a downward extending latch head 126 of equal width, i.e., left to right dimension as viewed in FIG. 1. Latch arms 128 adjacent to each of the outer arms 124 are also identical to each other with each having a head 129 of equal width and the outer ends thereof aligned with the outer ends of the the heads 126. The latch arms are thus arranged in identical pairs, one of each pair being in the forward group and the other of each pair being in the rearward group. Each identical pair has a head of equal width, which width is greater than the width of the head on adjacent arms on the outer side and less than the width of the head on the adjacent arm on the inner side. The lower edges of all the heads rest on lower roller 56 when the jack is fully lowered as shown in FIG. 1. As the jack is extended, i.e., top 26 is elevated, the lower roller 56 rolls to the left as viewed in FIGS. 3 and 5. Once roller 56 has cleared the left edge of head 126 on arm 124, head 126 will drop under the influence of gravity, as shown in FIG. 5. FIGS. 6, 7 and 8 show the progression of roller 56 to the left as top 26 is elevated with additional latch heads falling behind roller 56 with each incremental increase in elevation. Inner latch arms 122, which latches have heads 132 of maximum width, are the last to fall behind roller 56 and lock jack 10 at its maximum elevation because roller 56 cannot move to the right, as viewed in FIG. 8, which movement is required to lower the jack's elevation. The heads of the latch arms bear against end wall 60 of base 12 and positively block movement of roller 56 to the right. Clearance between rod 112 and the holes in the latch arms through which the rod passes accommodates the slight horizontal shifting required for the heads to contact the end wall 60. Jack 10 is thus locked at incremental stages as each of the pair of latch arms drop behind roller 56 and thereby prevent its movement to the right.

The latches do not necessarily have to be arranged in the progression shown herein. However, it is convenient to have the inner latches of greatest width, in order that the single spacer bar 120 will maintain group integrity without interfering with the operation of the remaining latch arms, and the outer latches of shortest width to facilitate release of the lock, as explained hereinbelow. It is also preferred that outer heads 126 fall first to contact roller 56 to minimize the deflection of roller 56. The forces in the horizontal direction, i.e., the forces exerted on the roller by the heads, are higher at lower elevations of the jack. The bending movement in roller 56, and hence the deflection thereof, will be lower when the forces exerted on roller 56 are closer to its connection to the inner arms 24.

An arched bar 140 is secured to each of outer latch arms 124 and extends just below each of the outer latch arms when all latch arms are at the same angle. Because outer arms 124 have the shortest width latch heads, heads 126 of the outer arms drop first and thus the bar 140 moves away from the other latch arms permitting each pair to rotate without interference. Air cylinder 142 is secured to the bracket 118 between the two groups of latch arms. Piston rod 144 of air cylinder 142 is extended when cylinder 142 is pressurized to contact bar 140. Outer latch arms 124, and any other latch arms that have had their heads dropped will be rotated counterclockwise as viewed in FIG. 1, which rotation will extract the associated heads from blocking the path of roller 56 to the right. The jack can then be lowered by exhausting air from air bag 66. A cover 146 is supported from ends 114 and 116 of bracket 118. Cover 146 is inclined to accommodate the angle assumed by the arms when resting on roller 56. Cover 146 prevents excessive rotation of the latch arms when the rod 144 is extended and also prevents debris from falling onto or between the latch arms.

Air pressure is supplied to jack 10 through a conventional quick release connector 150 to which a compatible connector communicating with a source of air under pressure may be attached. A conduit 152, as best seen in FIG. 4, transmits air pressure from the connector 150 to a pair of normally closed valves 154 and 156. The outlet of valve 154 is connected by conduit 158 to air cylinder 142. Depressing button 160 associated with valve 154 directs air pressure through conduit 158 to air cylinder 142 causing it to extend. Releasing button 160 blocks communication between conduits 158 and 152. The pressure in single acting cylinder 142 bleeds out through small orifice 162 in communication with conduit 158 permitting rod 144 to retract but only when valve 154 is closed, blocking communication between supply conduit 152 and conduit 158. Outlet of valve 156 is connected with air bag 66 through conduit 164. Depressing button 166 associated with valve 156 connects conduits 152 and 164 directing air pressure to air bag 66 through pipe 68 causing the jack to elevate. In order to lower the jack, button 160 must be depressed, to release the lock mechanism, while simultaneously depressing button 168 to open valve 170. Conduit 172 connects with valve 170 and is is T connected to conduit 164. The outlet of valve 170 simply exhausts to atmosphere so that depressing button 168 opens valve 170 to exhaust air from air bag 66. Simultaneously opening both valves 154 and 170 releases lock mechanism 110 and exhausts air bag 66 to atmosphere permitting jack 10 to lower. A second supply conduit 174 is T connected to conduit 152 by a fitting 176 into which connector 150 is threaded. A fitting 178 is connected to the other end of conduit 174 with plug 180 threaded therein to seal conduit 174. Plug 180 and connector 150 may be interchanged to accommodate a source of air pressure located more conveniently or to permit jack 10 to be reoriented 180 degrees and still access the same air source.

Tool tray 190, as seen in FIGS. 2 and 4, has a generally U-shaped tubular member 192 attached to the base 12, which functions as a convenient handle to roll jack 10 on the rollers 14 and 16 along the jack rails of an automotive lift. A wall member 194 extends downward from and is secured to tubular member 192. Floor member 196 extends between and is secured to the base 12 and the wall member 194. Floor member 196 is positioned intermediate the vertical height of wall member 194 and functions as a shallow tray to hold tools and small parts. The portion of the wall member 194 below floor member 196 serves to mount valves 154, 156 and 170 with their actuating buttons protruding therethrough. Valves 154 and 170 are separated so two hands are required to depress buttons 160 and 168 to reduce the possibility of injury while lowering the jack. Floor 196 and the lower portion of wall 194 aid in mounting and protecting the conduits connected to the valves, air bag and cylinder. Floor 196 is provided with a pair of openings to accept mounting posts 288 of pad extensions 290 for storage. Extensions 290 may be inserted in the sockets intended for posts 88 of pads 90 and posts 88 of pads 90 inserted into socket 292 of extensions 290 to vertically elevate pads 290 relative to jack 10.

While a preferred embodiment of the present invention has been disclosed herein, various changes may be made therein without departing from the spirit of the invention as defined by the scope of the claims.

What is claimed is:

1. A scissor jack comprising:

a base with an upper surface lying generally in a horizontal plane and an end wall extending upwardly from said upper surface;

a top lying generally in a horizontal plane and which may be moved vertically between a raised position and a lowered position;

means for moving said top upward and downward between said raised and lowered positions;

first and second scissor assemblies, each of said scissor assemblies having a first and second scissor arm each of said scissor arms having a top end, a base end, and a center portion said first and second scissor arms pivotally connected to each other at said center portions, said base end of said first arm rotatably attached to said base and said top end of said second arm rotatably attached to said top;

top attachment means for attaching said first arm top ends to said top to allow only rotational and horizontal displacement of said first arm top ends;

a cylindrical roller having a horizontal, longitudinal roller axis extending from a first roller end to a second roller end, said first and second roller ends rotatably attached to said base ends of said second arms of said first and second scissor assemblies, respectively, and said roller supported by said upper surface of said base such that said roller rolls along a path normal to said roller axis from a first position adjacent said end wall when said top is in the lowered position to a second position away from said end wall when said top is elevated to said raised position;

an elongate latch arm, said latch arm having a first end pivotally attached to said upper surface of said base at a pivot point more distant from said end wall than said second roller position, said latch arm extending along a longitudinal axis generally perpendicular to said roller axis toward said end wall to a distal end, said pivot point and said distal end separated by a distance less than the distance between said pivot point and said end wall, said latch arm further comprising a latch head extending downwardly a distance greater than a diameter of said roller to a latch head lower edge and extending back along said latch arm axis from said distal end toward said first end over a latch head width such that, when said roller is adjacent to said end wall said latch head lower edge rests upon and is supported by said roller and when said roller is separated from said end wall by a distance greater than said latch head width, said latch head drops to a position in which said latch head lower edge is supported by said upper surface of said base and said latch head is interposed between said end wall and said roller.

2. The invention according to claim 1 further comprising;

release means to selectively rotate said latch arms to raise said heads from between said end wall and said roller.

3. The invention according to claim 2, wherein said release means comprises;

a bar attached to a first latch arm with a first latch head of narrow width and extending under a second latch arm with a latch head of greater width than said narrow width; and an air cylinder having a piston capable of contacting said bar.

4. A scissor jack having a base, an end wall extending upward from the base, a raisable top and means for moving the top upwardly and downwardly between raised and lowered positions comprising;

first and second inner scissor arms each pivotally attached at a base end to said base;

first and second outer scissor arms each pivotally attached at a top end to said top;

First pivotable attachment means for pivotally attaching said first inner arm and said first outer arm in abutting relation;

second pivotally attachment means for pivotally attaching said second inner arm and said second outer arm in abutting relation;

first and second upper rollers rotatably mounted on a top end of said first and second inner arm, respectively, and supporting said top;

a cylindrical lower roller having a first and second roller end each lying on a longitudinal roller axis, said first and second roller end rotatably connected to a lower end of said first and second outer arm, respectively, and supported by said base such that said lower roller moves from a first position adjacent the end wall when said top is in the lowered position to a second position a distance further from the end wall than said first position when said top is moved to the raised position;

a latch arm pivotally connected to said base at a base end and extending toward the end wall and above said lower roller to a distal end adjacent the end wall;

a latch head extending downward from said distal end to a lower edge and;

said latch head having a latch head width smaller than said distance such that said lower edge is supported by said lower roller when said lower roller is in said first position and drops to be supported by said base when said lower roller is in said second position.

5. A scissor jack as in claim 4, further comprising:

a plurality of latch arms, each of said latch arms having a latch head of unique latch head width, such that, as said top is moved upward from said lowered to said raised position, latch heads successively drop between said lower roller and the end wall.

6. The invention according to claim 5 including an uneven numbered plurality of latch arms separated into a forward and a rearward group of equal number, one latch head in each group having a width equal to the width of one latch head in the other group.

7. The invention according to claim 6 further comprising;

a spacer bar connected to the inner ones of the latch arms in each of said groups to insure the integrity of and separation between said groups.

8. The invention according to claim 7 wherein heads of narrowest width are on outer latch arms and latch heads of the wider width are on inner latch arms.

9. The invention according to claim 8, further comprising;

a release bar secured to said outer latch arms and extending under the other latch arms.

10. The invention according to claim 9 further comprising an air cylinder having a piston capable, upon extension, of contacting said release bar to raise all of said latch arms.

11. The invention according to claim 10 and further comprising a tool tray including:

a U-shaped tubular member having both ends attached, a wall member attached to and extending downward a floor member attached to said wall member intermediate its height wherein said u-shaped tubular member may also serve as a handle.

12. The invention according to claim 11 and further comprising, a first valve for directing air pressure to said air cylinder mounted on said wall member below said floor member.

13. The invention according to claim 12 and further comprising;

an air bag connected between said base and said top;

a second valve for directing air pressure to said air bag for elevation of said top mounted on said wall member below said floor member;

a third valve means connected to exhaust air from said air bag mounted on said wall member below said floor member; and said first and third valve being separated a distance sufficient to require two hands for operation thereof.

* * * * *